US007774863B2

(12) United States Patent
Garza

(10) Patent No.: US 7,774,863 B2
(45) Date of Patent: Aug. 17, 2010

(54) COMBINATION HAT-BAG

(76) Inventor: Sandra Garza, 295 Crestwood, West Chicago, IL (US) 60185

( * ) Notice: Subject to any disclaimer, the term of this patent is extended or adjusted under 35 U.S.C. 154(b) by 546 days.

(21) Appl. No.: 11/897,336

(22) Filed: Aug. 30, 2007

(65) Prior Publication Data

US 2009/0055995 A1 Mar. 5, 2009

(51) Int. Cl.
*A42B 1/00* (2006.01)

(52) U.S. Cl. ..... 2/209.11

(58) Field of Classification Search ..... 2/247, 2/209.11

See application file for complete search history.

(56) References Cited

U.S. PATENT DOCUMENTS

| | | | | |
|---|---|---|---|---|
| 919,984 | A | | 4/1909 | Powell et al. |
| 1,172,927 | A | | 2/1916 | Bloch |
| 1,269,594 | A | | 6/1918 | Geraghty |
| 1,330,299 | A | | 2/1920 | Ballard |
| 1,422,435 | A | * | 7/1922 | Gooding ..... 2/182.1 |
| 2,122,171 | A | | 6/1938 | Alexander |
| 2,708,273 | A | | 5/1955 | Bonaventura |
| 2,731,997 | A | * | 1/1956 | Muth et al. ..... 383/4 |
| 3,072,916 | A | * | 1/1963 | Henderson ..... 2/209.11 |
| 3,285,307 | A | | 11/1966 | Dormaier |
| 4,165,542 | A | | 8/1979 | McLaughlin |
| 4,357,020 | A | | 11/1982 | Van Bryant, Jr. |
| 4,610,038 | A | | 9/1986 | Dennard |
| 4,937,885 | A | * | 7/1990 | Gregg ..... 2/209.11 |
| 5,173,970 | A | | 12/1992 | Shifrin |
| 5,214,802 | A | | 6/1993 | McCallum |
| 5,303,427 | A | | 4/1994 | Fishbaine |
| 5,450,629 | A | | 9/1995 | Gilstrap |
| 5,579,540 | A | | 12/1996 | Walker |
| 5,664,257 | A | | 9/1997 | Hall |
| 5,799,335 | A | | 9/1998 | Ethier |
| 6,230,331 | B1 | | 5/2001 | Aguilar et al. |

* cited by examiner

*Primary Examiner*—Katherine Moran
(74) *Attorney, Agent, or Firm*—Meroni & Meroni, P.C.; Charles F. Meroni, Jr.; Christopher J. Scott

(57) ABSTRACT

A combination bag-hat contains bag-hat-received matter and comprises a body assembly, a continuous hat-to-bag cinching cord, and a continuous open end-encircling cord. The body assembly comprises a cord-concealing, intermediate fabric layer, and a matter-containing, outer fabric layer. The outer fabric layer comprises opposing pairs of cord-letting apertures. The cinching cord is substantially disposed between the outer and intermediate fabric layers, and extends through the cord-letting apertures for forming opposing cord-linking loops. The outer and intermediate fabric layers conceal, fabric-guide, and frictionally engage the cinching cord during hat-to-bag cinching action. The encircling cord is disposed externally relative to the outer fabric layer and extends through the cord-linking loops. The encircling and cinching cords are tensionable for closing the open end and converting the bag-hat combination from a hat to a bag.

21 Claims, 6 Drawing Sheets

COMBINATION HAT-BAG

BACKGROUND OF THE INVENTION

1. Field of the Invention

The present invention generally relates to a combination article which may function as both a hat and a bag. More particularly, the present invention relates to a hat-bag combination having a uniquely configured linked cord assembly for enabling hat-to-bag conversion.

2. Description of Related Art

A number of prior art patents disclose a head covering which may also function as a bag or a carrying case. Some of the more pertinent prior art relating to combination articles of clothing, including hat-bag combinations and the like are briefly described hereinafter.

U.S. Pat. No. 1,172,927 ('927 Patent), which issued to Bloch, discloses a Bathing Cap. The '927 Patent teaches a cap having an opening in the crown, means for closing the opening, and a lining member normally positioned within the crown but capable of withdrawal to form, with the cap proper, a bag or receptacle.

U.S. Pat. No. 1,269,594 ('594 Patent), which issued to Geraghty, discloses a Combined Cap and Hand Bag. The '594 Patent teaches a body member having a box seam extending transversely thereof and further provided with wings located at the opposite sides of the box seam and having their lower edges lying in the rim line of the body member, the folds forming the wings being closed at said rim line of the body.

U.S. Pat. No. 2,122,171 ('171 Patent), which issued to Alexander, discloses a Combined Hat and Handbag. The '171 Patent teaches a combination hat and handbag in the form of a pouch with a cross-wise mouth, said pouch being of a size to fit over the crown of the head when used for a hat; complemental slide fastener lugs secured along the opposite side edges of the mouth, and a fastener slide cooperating with said lugs in closing the pouch, said lugs permitting the mouth to bend around the head when open; and means for connecting the pouch walls across the mouth and forming a sling for carrying the pouch when used as a handbag, yet leaving the mouth free to open when disconnected.

U.S. Pat. No. 2,708,273 ('273 Patent), which issued to Bonaventura, discloses a Multipurpose Article of Feminine Wear. The '273 Patent teaches a multi-purpose article comprising a generally flat bag rectangular in outline and having an opening at the top, said bag opening having a perimeter to fit about the human head, a first separable fastener having its component parts secured respectively to the upper and lower corners of said bag adjacent a first side edge thereof and on one side of said bag, second separable fastener having its component parts of said first separable fastener and having its other component part secured adjacent said second side edge midway between the component parts of said second separable fastener.

U.S. Pat. No. 5,303,427 ('427 Patent), which issued to Fishbaine, discloses a Combination Hat and Bag. The '427 Patent teaches a hat/bag combination article formed from a tubular member having a closed end and an opposed open end with a drawstring closure. The article can be attractively and inexpensively made from strips of pile fleece to provide a warm and stylized lightweight hat and alternatively as a drawstring bag for holding gloves or other articles and which may be attached to the user's belt loop or wrist.

U.S. Pat. No. 5,664,257 ('257 Patent), which issued to Hall, discloses a Convertible Bag/Hat/Halter Top. The '257 Patent teaches a combination, convertible hat/bag/halter top formed from an elasticized strip which can be connected at a first end to form a closed loop, to which a dividable body is attached. The elasticized strip may be connected at one end to form a closed loop. The article converts easily into a hat, a bag and a halter top.

It may be seen from an inspection of the prior art that the art is silent on a combination hat-bag comprising inner and outer fabric layers and a linked cord assembly extending therethrough for enabling conversion of the hat-bag combination from a hat mode to one or more bag modes at the user's election. The prior art thus perceives a need for such a combination article, the particulars of which are set forth in more detail hereinafter.

SUMMARY OF THE INVENTION

In view of the fact that the prior art is silent on a combination hat-bag having a linked cord assembly, a primary object of the present invention is to provide a versatile combination article, which may be manufactured in a convenient, durable and inexpensive manner. To achieve these and other readily apparent objectives, the hat-bag combination of the present invention essentially discloses a combination hat/bag, which combination hat/bag essentially functions to contain hat/bag-received matter, and comprises a body assembly having a matter-receiving open end; a matter-concealing closed end opposite the open end; a cord-concealing, intermediate fabric layer; a matter-concealing, outer fabric layer, an inner cord; and an outer cord. The inner cord is substantially disposed between an interior fabric surface of the outer fabric layer and the intermediate fabric layer. The inner cord extends through the outer fabric layer via cord-letting apertures.

The outer and intermediate fabric layers essentially function to conceal, fabric-guide, and frictionally engage the inner cord, particularly during hat-to-bag cinching action. The outer cord is disposed externally relative to the exterior fabric surface of the outer fabric layer and is linked to the externally exposed link portions of the inner cord. The inner cord is displaceable relative to the outer and intermediate fabric layers by tensioning the inner cord via the outer cord. The outer and inner cords may well function to selectively close the open end and convert the combination hat/bag from a hat mode to a first bag mode.

Stated another way, the hat-bag combination of the present invention comprises a matter-concealing, outer fabric layer, a cord-concealing, intermediate fabric layer, and a linked cord assembly. The linked cord assembly comprises outer and inner cords, which cords are linked via the outer fabric layer. The outer and intermediate fabric layers essentially function to conceal and fabric-guide the inner cord during hat-to-bag cinching action during which the inner cord is displaceable relative to the outer and intermediate fabric layers. The linked cord assembly thus functions to selectively convert the hat-bag combination from a hat mode to a first bag mode.

BRIEF DESCRIPTION OF THE DRAWINGS

Other features of my invention will become more evident from a consideration of the following brief description of patent drawings:

FIG. 5(*a*) is a fragmentary bottom plan type view of a portion hat-bag combination showing a cord-concealing intermediate fabric layer attached to an outer fabric layer with a hat-to-bag cinching cord sandwiched therebetween and extending through cord-letting apertures of the outer fabric layer.

FIG. 5(*b*) is a fragmentary edge view type depiction of the structures otherwise depicted in FIG. 5(*a*) showing a foundational outer fabric layer, a hat-to-bag cinching cord, and cord-concealing intermediate fabric layer attached to the outer fabric layer.

FIG. 12(*b*) is a second fragmentary bottom plan view type depiction of a brim portion of the hat-bag combination showing the intermediate fabric layer shown in a second radially outward position for maximized volumetric bag capacity.

DETAILED DESCRIPTION OF THE PREFERRED EMBODIMENT

Figure 1:
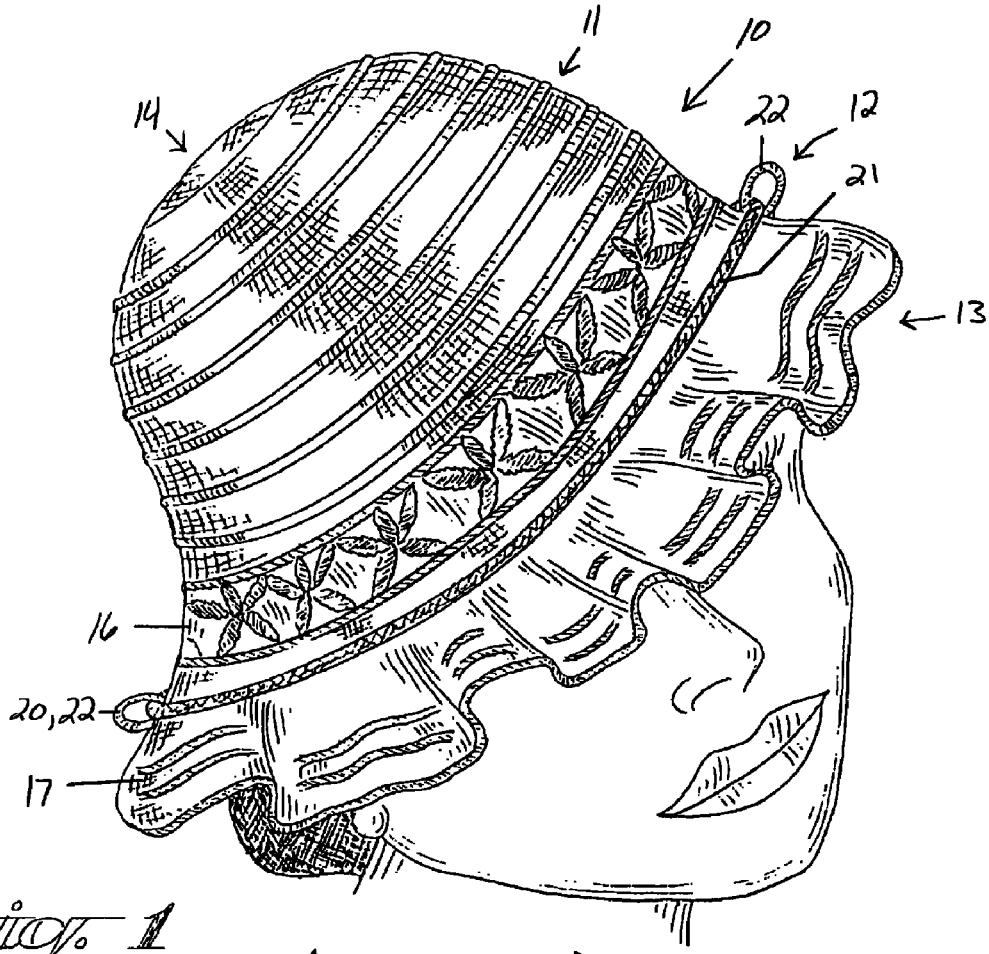
FIG. 1 is a top perspective type depiction of the hat-bag combination as worn upon a user's head while in hat mode.

Hats may be worn for any number of reasons. Most typically, hats may be worn for fashion and for providing certain head-containing or head-covering means for maintaining the user's head in a preferred temperature state (i.e. the hat may be worn to keep the head warm or cool), or for protecting the user's head from the elements. Bags are typically utilized to contain useful articles. The combination of the two articles into a single article thus provides a multifunctional, combination article. The present invention concerns a combination hat-bag 10 and is generally illustrated and referenced in FIGS. 1-5, and 6-11.

The bag-hat combination or combination hat-bag 10 of the present invention essentially functions to contain matter (such as one's head or useful articles) as received thereby. In other words, it is contemplated that the combination hat-bag may well function to contain hat-bag-received matter. To achieve this function, the bag-hat combination 10 preferably comprises a flexible body or body assembly 11, and a linked cord assembly 12 both as illustrated and referenced in FIGS. 1-4, and 11.

The body assembly 11 preferably comprises a matter-receiving open end 13 as generally illustrated and referenced in FIGS. 1-4, 5, and 6-10. The open end is depicted in a closed state in FIG. 11. In other words, a closed open end is generally depicted and referenced at 13' (13 prime) in FIG. 11. The body assembly 11 further comprises a matter-containing closed end 14 as referenced in FIGS. 1, 3, 5, and 6-10; one or more cord-concealing, intermediate layers of fabric or fabric layer(s) 15 as illustrated and referenced in FIGS. 5-5(*b*), 7, 12(*a*), and 12(*b*); and a matter-containing, outer fabric layer 16 as illustrated and referenced in FIGS. 1-12(*b*), inclusive.

Figure 2:
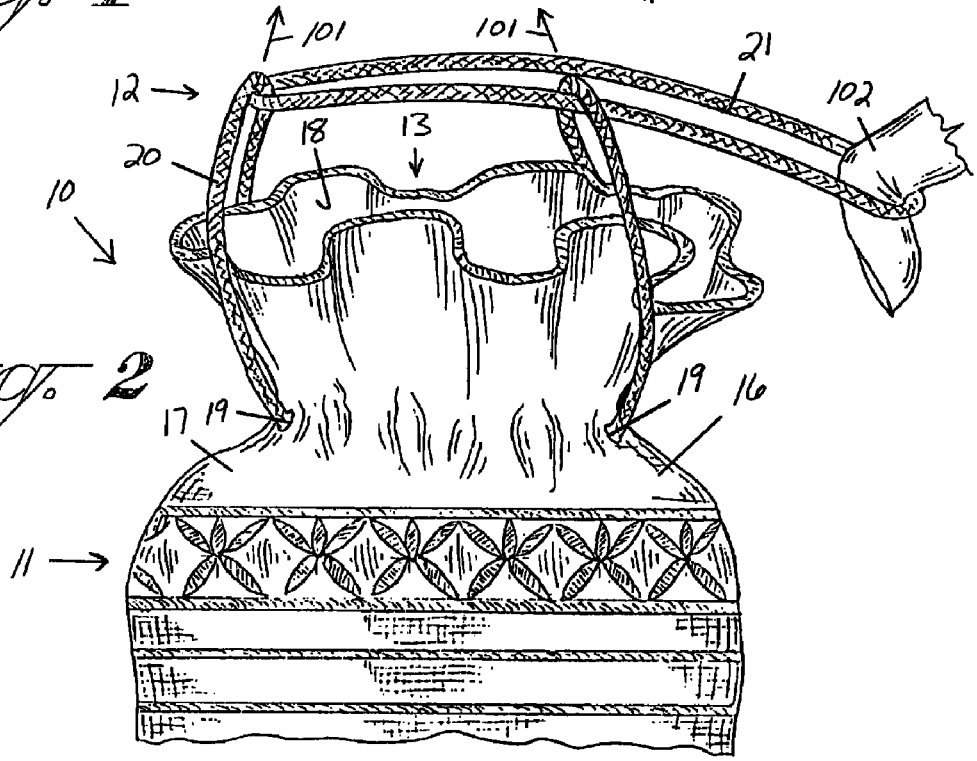
FIG. 2 is a first fragmentary side view type depiction of the hat-bag 10 combination with its open end being manually cinched shut into a first bag mode.
Figure 3:
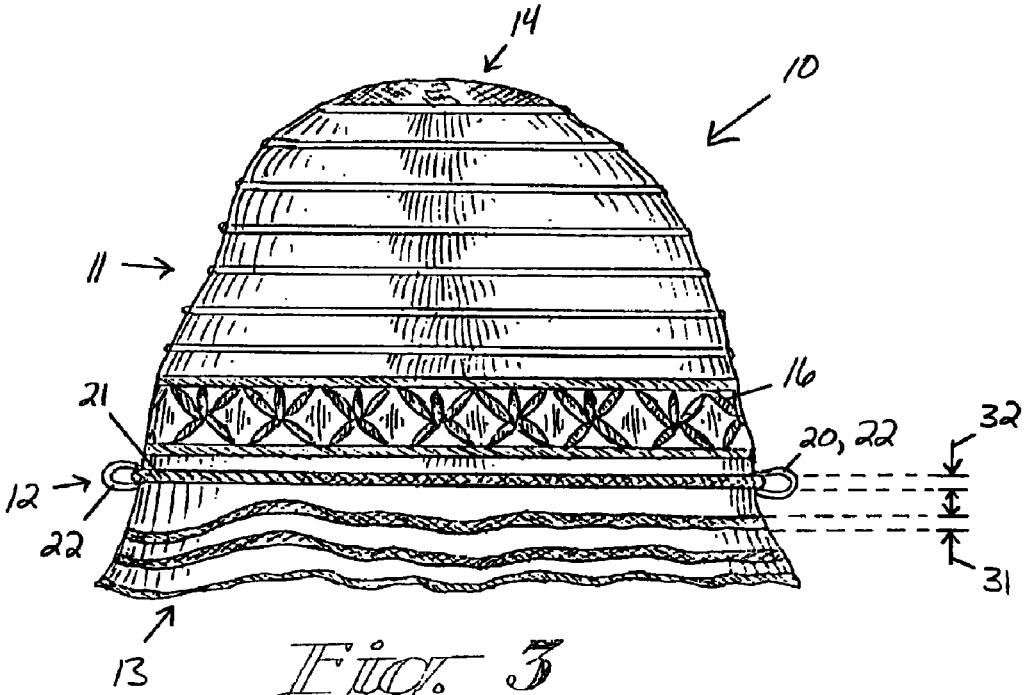
FIG. 3 is a first side plan view type depiction of the hat-bag combination in a head-receiving hat mode.
Figure 4:
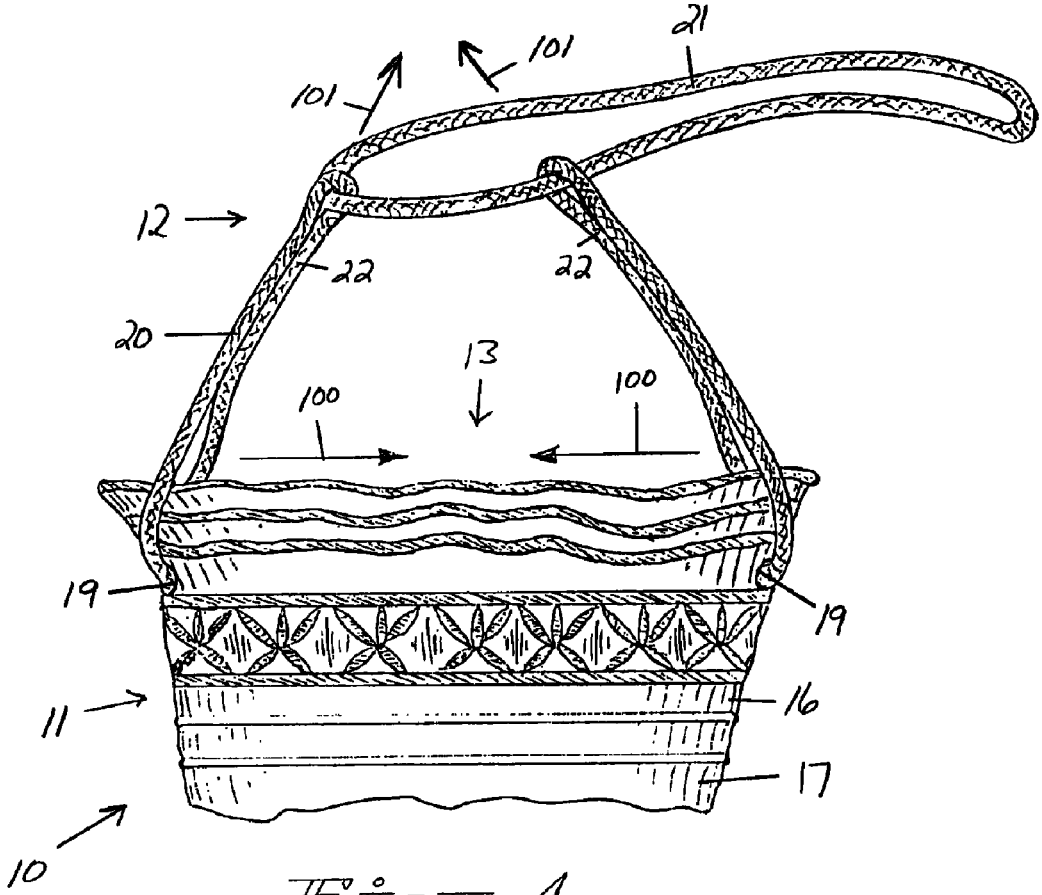
FIG. 4 is a second fragmentary side view type depiction of the hat-bag combination with its open end being manually cinched shut into a first bag mode.
Figure 5:
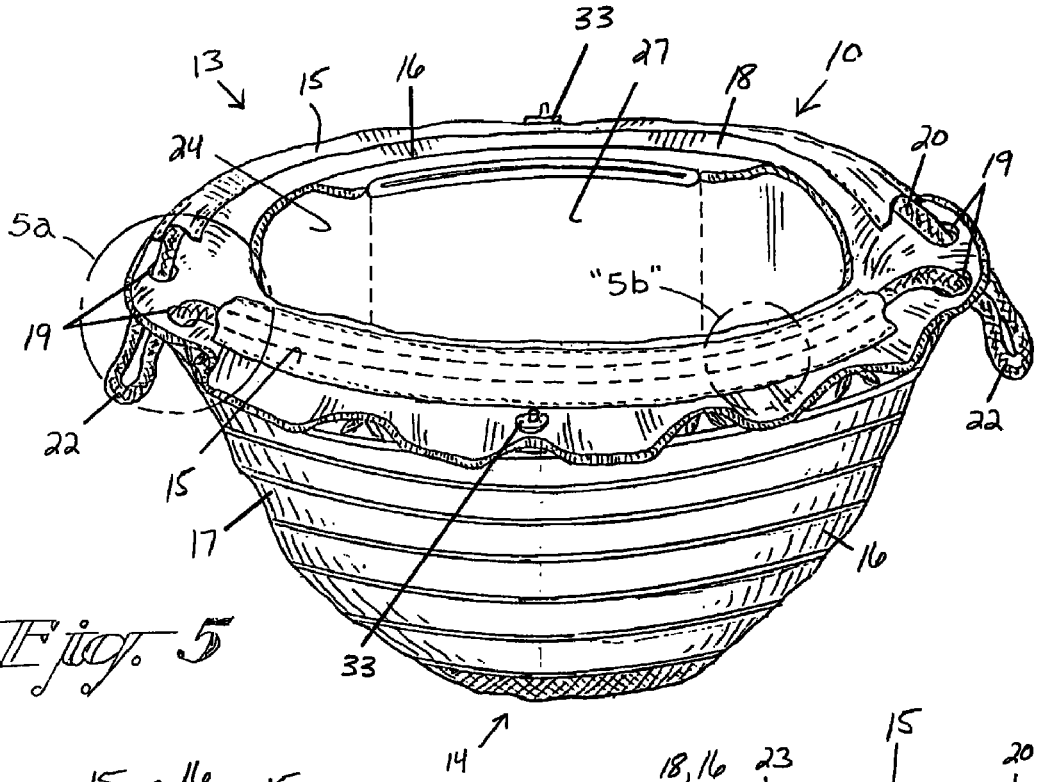
FIG. 5 is a first bottom perspective type depiction of the hat-bag combination with the open end encircling cord removed.
Figure 5A:
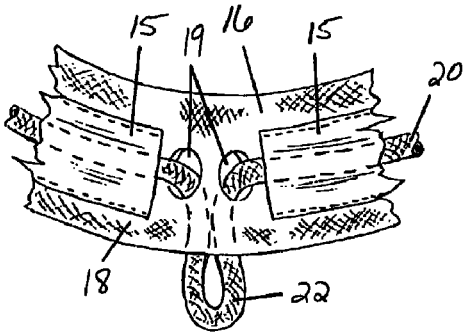
Figure 5B:
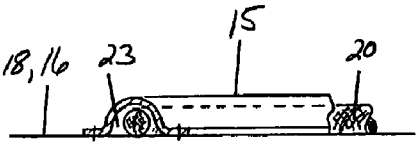
Figure 6:
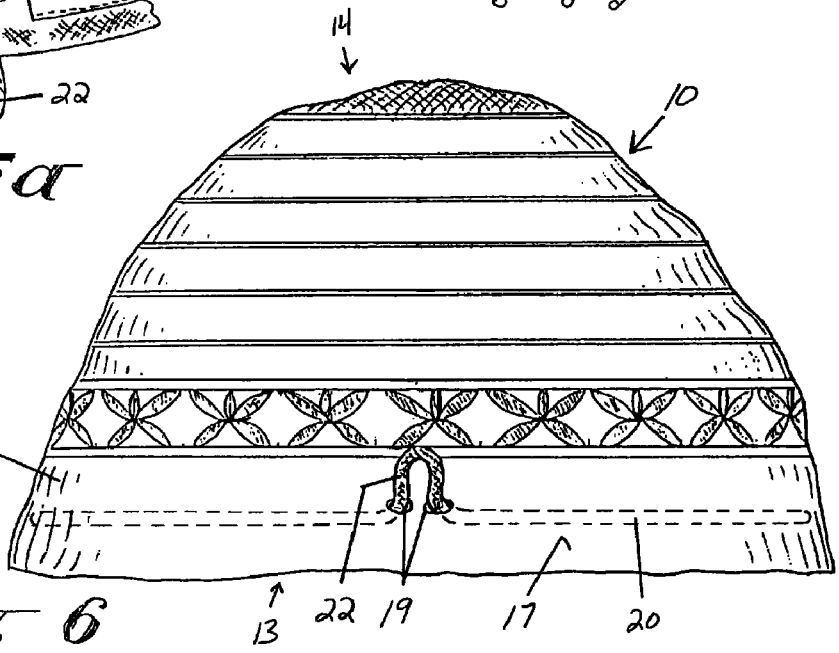
FIG. 6 is a second side plan view type depiction of the hat-bag combination in a head-receiving hat mode with the open end encircling cord removed.
Figure 7:
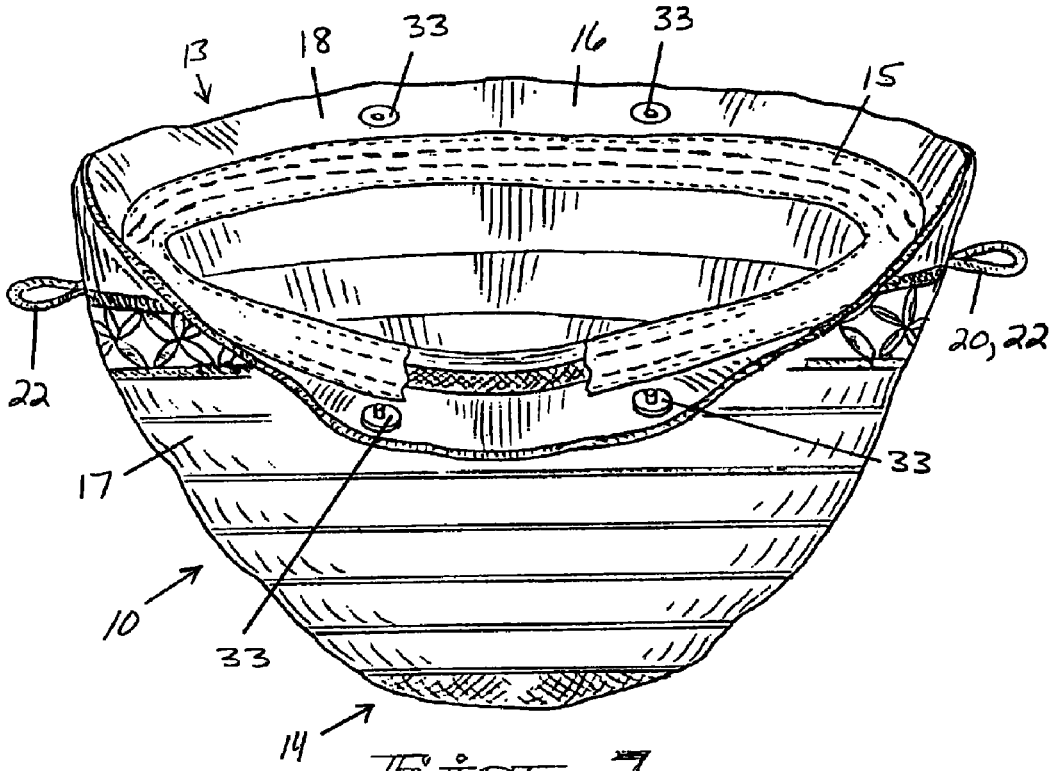
FIG. 7 is a second bottom perspective type depiction of the hat-bag combination with the open end encircling cord removed showing a fragmentary cord-concealing intermediate fabric layer, a portion thereof having been removed to reveal the hat-to-bag cinching cord.
Figure 8:
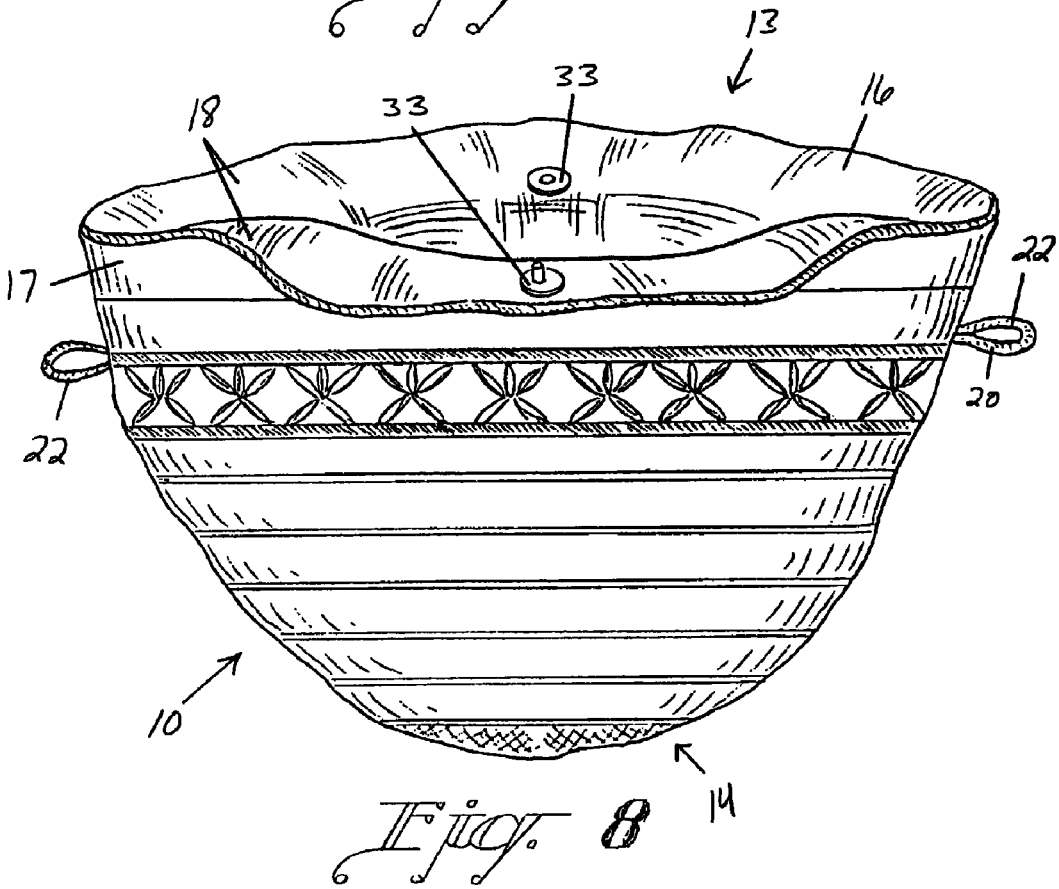
FIG. 8 is a third bottom perspective type depiction of the hat-bag combination with the open end encircling cord removed showing open end closing snaps for snapping shut the open end.
Figure 9:
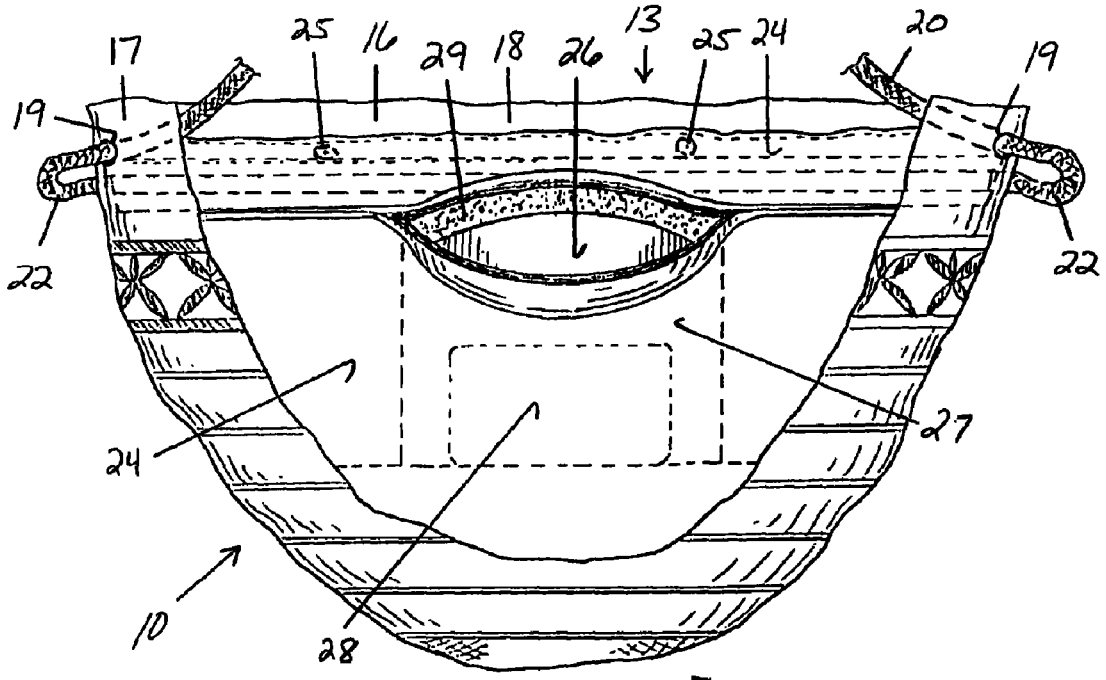
FIG. 9 is a first fragmentary side view type depiction of the hat-bag combination with portions thereof removed to show an inner lining fabric layer with pocket structure having hook and loop fastening structure for opening/closing the pocket.
Figure 10:
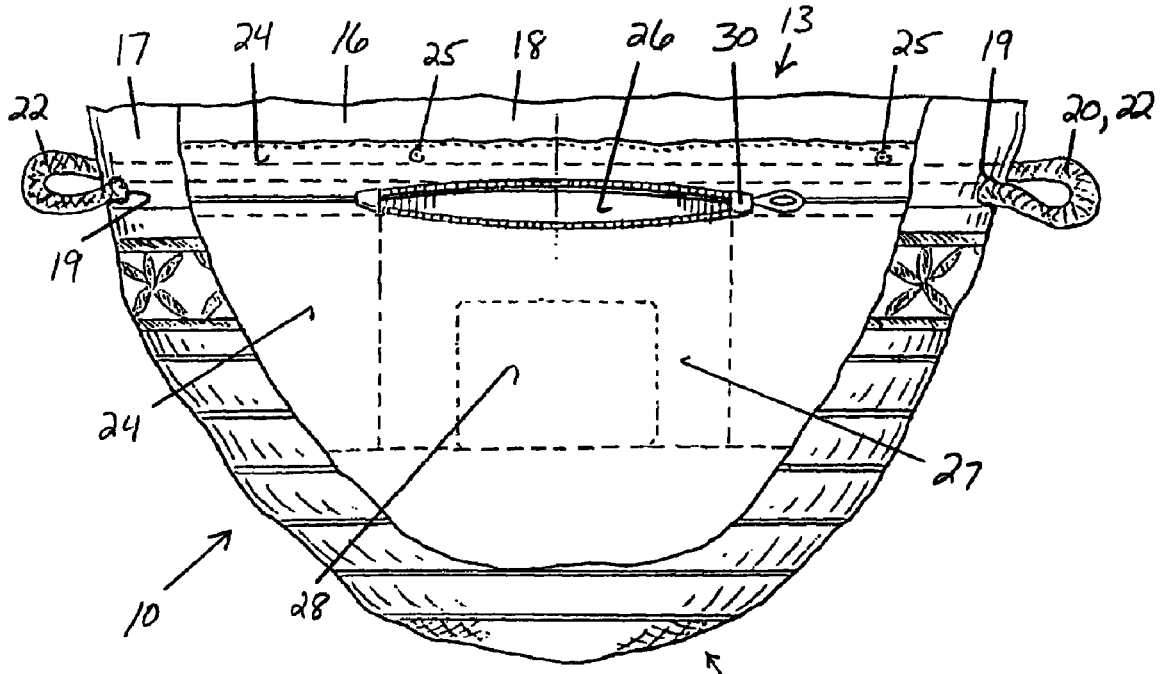
FIG. 10 is a second fragmentary side view type depiction of the hat-bag combination with portions thereof removed to show an inner lining fabric layer with pocket structure having zipper type structure for opening/closing the pocket.
Figure 11:
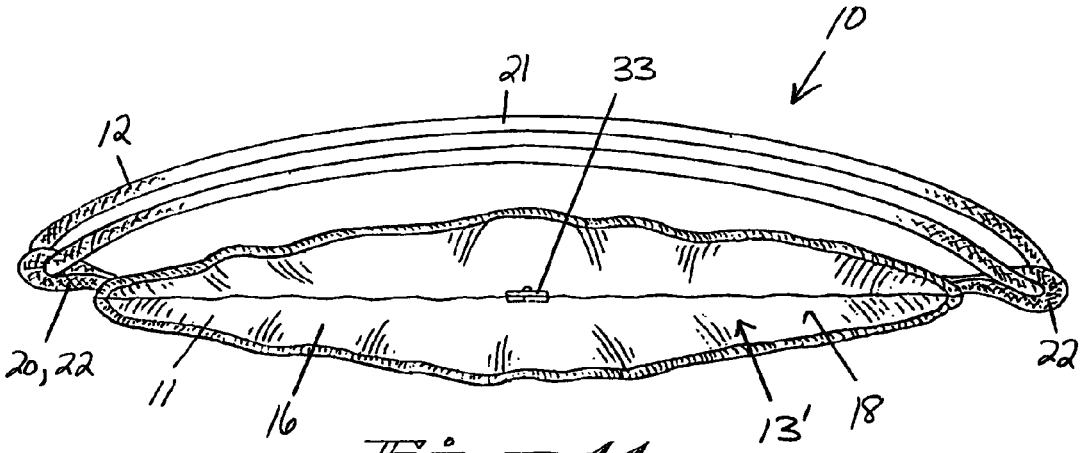
FIG. 11 is a top plan view of the hat-bag combination with the open end encircling cord offset therefrom to enable manual retention of the hat-bag combination while in a second bag mode.
Figure 12A:
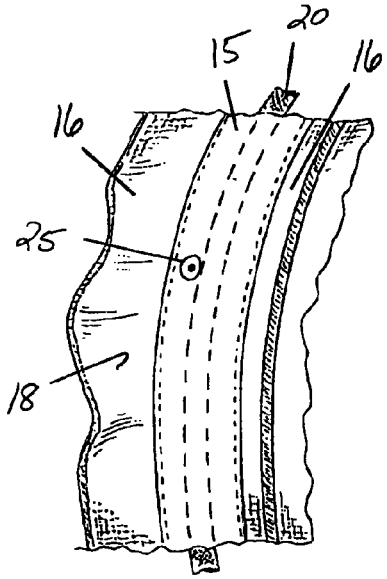
FIG. 12(*a*) is a first fragmentary bottom plan view type depiction of a brim portion of the hat-bag combination showing the intermediate fabric layer shown in a first radially inward position for minimized volumetric bag capacity.
Figure 12B:
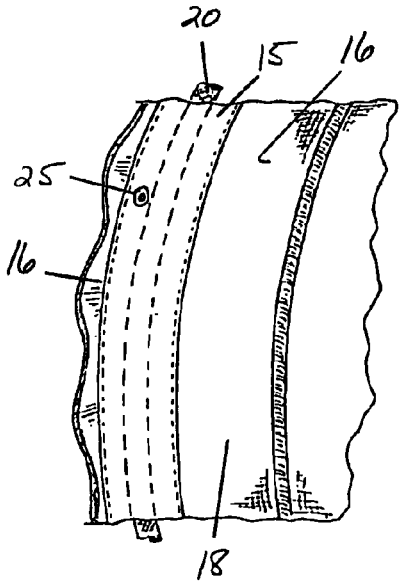

It is contemplated that the outer fabric layer 16 may be preferably constructed from fabrics such as suede, leather, cotton, denim, yarn, or spandex, and preferably comprises an exterior fabric surface 17 as generally depicted in FIGS. 1-5, and 6-10; an interior fabric surface 18 as generally depicted in FIGS. 2, 5, 5*a*, 5(*b*), and 7-12(*b*); opposing pairs of cord-letting apertures 19 as generally illustrated and referenced in FIGS. 2, 4, 5, 5(*a*), 6, 9, and 10; and certain open end closure means for selectively closing the open end 13 and enabling a non-cinching, second bag mode as generally depicted in FIG. 11. It is contemplated that the open end closure means may be preferably defined by cooperable snap structures as at 33 in FIGS. 5, 7, 8, and 11.

It may be seen from an inspection of the noted figures that the exterior fabric surface 17 may preferably comprise a visual marking pattern, which visual marking pattern comprises a pattern thickness as particularly referenced at 31 in FIG. 3. Further referenced in FIG. 3 is a cord thickness as at 32 of the encircling cord 21. In other words, the encircling cord 21 may preferably comprise a certain cord thickness 32 such that the pattern thickness 31 and the cord thickness 32 are substantially similar in magnitude for camouflaging the encircling cord 21 when the hat-bag combination 10 receives a user's head and/or is worn in the hat mode as generally depicted in FIGS. 1 and 3.

The linked cord assembly 12 preferably comprises a continuous hat-to-bag cinching cord 20 as illustrated and referenced in FIGS. 1-12(*b*), inclusive; and a continuous open end-encircling cord 21 as illustrated and referenced in FIGS. 1-4, and 11. It may be seen from an inspection of the noted figures that the cinching cord 20 is substantially disposed between the interior fabric surface 18 and the intermediate fabric layer(s) 15, and extends through the cord-letting apertures 19 for forming opposing cord-linking loops as at 22 in FIGS. 1, 3-5(*a*), and 6-11. The outer fabric layer 16 and the intermediate fabric layer 15 (preferably stitched to the outer fabric layer 16) essentially function to conceal, fabric-guide, and frictionally engage the cinching cord 20 during hat-to-bag cinching action as generally depicted in FIGS. 2 and 4.

In other words, the fabric layers 15 and 16 conceal the cord 20, and provide a certain conduit wall 23 for fabric-guiding the cord 20 (as generally depicted in FIG. 5(*b*)). Further, the fabric layers 15 and 16, and cord 20 preferably comprise materials having relatively high coefficients of friction so that when cord 20 is cinched relative to the layers 15 and 16, the hat-to-bag cinching action may frictionally retain the structure in a bag mode by closing (as at vectors 100 in FIG. 4) the open end 13.

It may be further seen from an inspection of the referenced figures that the open-end encircling cord 21 is disposed externally relative to the exterior fabric surface 17 and extends through the cord-linking loops 22 or is otherwise linked to the cinching cord 20 via the loops 22. In this regard, it may be readily understood from a consideration of the noted figures that the cinching cord 20 is displaceable relative to the outer and intermediate fabric layers 16 and 15 by tensioning the cinchable cord 20 via the encircling cord 21 as generally depicted in FIGS. 2 and 4 at vector arrow 101.

It should be noted that the cord 21 is not illustrated in the noted figures as directly imparting cord-tensioning forces (as originating from a finger 102, for example), but that certain cord tension may be imparted unto the cord 20 via the cord 21 when a force is applied thereto. The linked encircling and cinching cords 21 and 20 thus function to selectively close the open end 13 and convert the bag-hat combination from a hat to a bag or convert the structure from a hat mode (as generally depicted in FIGS. 1 and 3) to a first bag mode (as generally depicted in FIGS. 2 and 4). It is contemplated that the first bag mode may be defined by a cinched shut open end 13, and a second bag mode may be defined by a non-cinched shut open end 13. It will be recalled from above that the second bag mode is generally depicted in FIG. 11. From an inspection of FIG. 11, it may be readily understood that the encircling cord 21 may well provide certain bag-holding means for enabling manual retention of the hat-bag combination 10 when in the second bag mode.

The bag-hat combination 10 may further preferably comprise a bag-hat lining or inner fabric layer 24 as illustrated and referenced in FIGS. 5, 9, and 10. The inner fabric layer 24 may preferably be constructed from a washable fabric such as a thin satin or silky fabric so that the same may be periodically washed to maintain the general cleanliness of the bag-hat combination 10. The inner fabric layer 24 is preferably removably attached to the intermediate fabric layer 15 such that the inner fabric layer 24 conceals all or a portion of the intermediate fabric layer 15 when removably attached thereto as generally depicted in FIGS. 9 and 10. It is contemplated that the inner fabric layer 24 and intermediate fabric layer 15 may be outfitted with snaps cooperable snaps or snapping type structures as referenced at 25 in FIGS. 9, 10. 12(*a*), and 12(*b*).

The inner fabric layer 24 may be outfitted with a pocket-forming supplemental fabric layer as at 26 in FIGS. 9 and 10. It may be seen from an inspection of the noted figures that the supplemental fabric layer 26 is preferably disposed between the inner fabric layer 24 and the intermediate fabric layer 15 and attached to the inner fabric layer 24 for forming an article-receiving pocket as at 27, which pocket may be sized and shaped for holding any number of articles. It is contemplated that the compartment or pocket 27 in the hat-bag combination 10 may be preferably four by four inches and zippered shut therefore being able to hold money, credit cards or ID's while hat is being used in the hat mode.

An exemplary credit card 28 is generically depicted in FIGS. 9 and 10. The pocket may be selectively opened and closed by the incorporation of certain opening/closing means as may be defined by cooperative hook and loop fastening structure 29 as generally depicted in FIG. 9, or a zipper type structure 30 as generally depicted in FIG. 10. It is contemplated that the opening/closing means may well function to enable a user to selectively open/close the pocket 27.

It may thus be seen that the hat mode of the hat-bag combination generally depicted in FIG. 1 may be turned into a bag mode as generally depicted in FIGS. 2 and 4. The hat may thus snap shut via the snap structures 33. The hat-bag combination 10 can also be a shoulder bag if the encircling cord 21 is pulled upward and the open end 13 is cinched shut. The handbag version is generally considered to be the equivalent of the second bag mode.

While the above description contains much specificity, this specificity should not be construed as limitations on the scope of the invention, but rather as an exemplification of the invention. For example, as is described hereinabove, it is contemplated that the present invention essentially discloses a combination hat/bag, which combination hat/bag essentially functions to contain hat/bag-received matter, and comprises a body assembly having a matter-receiving open end; a matter-concealing closed end opposite the open end; a cord-concealing, intermediate fabric layer; a matter-concealing, outer fabric layer, an inner cord; and an outer cord. The inner cord is substantially disposed between an interior fabric surface of the outer fabric layer and the intermediate fabric layer. The inner cord extends through the outer fabric layer via cord-letting apertures.

The outer and intermediate fabric layers essentially function to conceal, fabric-guide, and frictionally engage the inner cord, particularly during hat-to-bag cinching action. The outer cord is disposed externally relative to the exterior fabric surface of the outer fabric layer and is linked to the externally exposed link portions of the inner cord. The inner cord is displaceable relative to the outer and intermediate fabric layers by tensioning the inner cord via the outer cord. The outer and inner cords may well function to selectively close the open end and convert the combination hat/bag from a hat mode to a first bag mode.

Stated another way, the hat-bag combination of the present invention comprises a matter-concealing, outer fabric layer, a cord-concealing, intermediate fabric layer, and a linked cord assembly. The linked cord assembly comprises outer and inner cords, which cords are linked via the outer fabric layer. The outer and intermediate fabric layers essentially function to conceal and fabric-guide the inner cord during hat-to-bag cinching action during which the inner cord is displaceable relative to the outer and intermediate fabric layers. The linked cord assembly thus functions to selectively convert the hat-bag combination from a hat mode to a first bag mode.

Although the invention has been described by reference to a preferred embodiment, it is not intended that the combination be limited thereby, but that modifications thereof are intended to be included as falling within the broad scope and spirit of the foregoing disclosure and the appended drawings.

I claim:

1. A bag-hat combination, the bag-hat combination for containing bag-hat-received matter, the bag-hat combination comprising:

a body assembly;

a continuous hat-to-bag cinching cord; and a continuous open end-encircling cord, the body assembly comprising a matter-receiving open end, a matter-containing closed end, a cord-concealing, intermediate fabric layer, and a matter-containing, outer fabric layer, the outer fabric layer having an exterior fabric surface, an interior fabric surface, and opposing pairs of cord-letting apertures, the cinching cord being substantially disposed between the interior fabric surface and the intermediate fabric layer and extending through the cord-letting apertures for forming opposing cord-linking loops, the outer and intermediate fabric layers for concealing, fabric-guiding, and frictionally engaging the cinching cord during hat-to-bag cinching action, the encircling cord being disposed externally relative to the exterior fabric surface and extending through the cord-linking loops, the cinching cord being displaceable relative to the outer and intermediate fabric layers by tensioning said cinchable cord via the encircling cord, the encircling and cinching cords thus for selectively closing the open end and converting the bag-hat combination from a hat mode to a first bag mode.

2. The bag-hat combination of claim 1 comprising a bag-hat lining inner fabric layer, the inner fabric layer comprising a washable fabric.

3. The bag-hat combination of claim 2 wherein the inner fabric layer is removably attached to the intermediate fabric layer, the inner fabric layer concealing the intermediate fabric layer when removably attached thereto.

4. The bag-hat combination of claim 3 comprising a pocket-forming supplemental fabric layer, the supplemental fabric layer being disposed between the inner fabric layer and the intermediate fabric layer and attached to the inner layer for forming an article-receiving pocket.

5. The bag-hat combination of claim 4 wherein the article-receiving pocket comprises pocket opening/closing means for enabling a user to selectively open/close the pocket.

6. The bag-hat combination of claim 1 wherein the exterior fabric surface comprises a visual marking pattern, the visual marking pattern comprising a pattern thickness, the encircling cord comprising a cord thickness, the pattern thickness and the cord thickness being substantially similar for camouflaging the encircling cord when the bag-hat combination receives a user's head and is worn in the hat mode.

7. The bag-hat combination of claim 1 wherein the outer fabric layer comprises open end closure means for selectively closing the open end and enabling a non-cinching, second bag mode.

8. The bag-hat combination of claim 7 wherein the encircling cord provides bag-holding means for enabling manual retention of the bag-hat combination when in the second bag mode.

9. A combination hat-bag, the combination hat-bag for containing hat/bag-received matter, the combination hat-bag comprising:

a body assembly, the body assembly comprising a matter-receiving open end, a matter-concealing closed end, a cord-concealing, intermediate fabric layer, and a matter-concealing, outer fabric layer, the outer fabric layer having an exterior fabric surface and an interior fabric surface; and a linked cord assembly, the linked cord assembly comprising an inner cord and an outer cord, the inner cord being substantially disposed between the interior fabric surface and the intermediate fabric layer and extending through the outer fabric layer, the outer and intermediate fabric layers for concealing, fabric-guiding, and frictionally engaging the inner cord during hat-to-bag cinching action, the outer cord being disposed externally relative to the exterior fabric surface and being linked to the inner cord, the inner cord being displaceable relative to the outer and intermediate fabric layers by tensioning said inner cord via the outer cord, the outer and inner cords thus for selectively closing the open end and converting the combination hat-bag from a hat mode to a first bag mode.

10. The combination hat-bag of claim 9 wherein the outer fabric layer comprises opposing pairs of cord-letting apertures, the opposing pairs of cord-letting apertures for forming opposing cord-linking loops externally relative to the exterior fabric surface, the outer cord being linked to the inner cord via the cord-linking loops.

11. The combination hat-bag of claim 9 comprising a hat-bag lining inner fabric layer, the inner fabric layer comprising a washable fabric.

12. The combination hat-bag of claim 11 wherein the inner fabric layer is removably attached to the intermediate fabric layer.

13. The combination hat-bag of claim 12 comprising a pocket-forming supplemental fabric layer, the supplemental fabric layer being attached to the inner layer for forming an article-receiving pocket.

14. The combination hat-bag of claim 13 wherein the article-receiving pocket comprises pocket opening/closing means for enabling a user to selectively open/close the pocket.

15. The combination hat-bag of claim 9 wherein the exterior fabric surface comprises a visual marking pattern, the visual marking pattern comprising a pattern thickness, the encircling cord comprising a cord thickness, the pattern thickness and the cord thickness being substantially similar for camouflaging the encircling cord when the combination hat-bag is in the hat mode.

16. The combination hat-bag of claim 9 wherein the outer fabric layer comprises open end closure means for selectively closing the open end and enabling a non-cinching, second bag mode.

17. The combination hat-bag of claim 16 wherein the encircling cord provides bag-holding means for enabling manual retention of the combination hat-bag when in the second bag mode.

18. A hat-bag combination, the hat-bag combination comprising:

an outer fabric layer, the outer fabric layer comprising opposed pairs of cord-letting apertures, the opposed pairs of cord-letting apertures for forming opposed cord-linking loops;

an intermediate fabric layer; and a linked cord assembly, the linked cord assembly comprising outer and inner cords, the outer and inner cords being linked via the cord-linking loops of the outer fabric layer, the outer and intermediate fabric layers for concealing and fabric-guiding the inner cord during hat-to-bag cinching action, the inner cord being displaceable relative to the outer and intermediate fabric layers, the linked cord assembly thus for selectively converting the hat-bag combination from a hat mode to a first bag mode.

19. A hat-bag combination, the hat-bag combination comprising:

an outer fabric layer;

an intermediate fabric layer;

a hat-bag-lining, inner fabric layer, said inner fabric layer comprising a washable fabric and being removably attached to the intermediate fabric layer; and a linked cord assembly, the linked cord assembly comprising outer and inner cords, the outer and inner cords being linked via the outer fabric layer, the outer and intermediate fabric layers for concealing and fabric-guiding the inner cord during hat-to-bag cinching action, the inner cord being displaceable relative to the outer and intermediate fabric layers, the linked cord assembly thus for selectively converting the hat-bag combination from a hat mode to a first bag mode.

20. The hat-bag combination of claim 19 comprising a pocket-forming supplemental fabric layer, the supplemental fabric layer being attached to the inner layer for forming an article-receiving pocket.

21. The hat-bag combination of claim 20 wherein the article-receiving pocket comprises pocket opening/closing means for enabling a user to selectively open/close the pocket.

* * * * *